US010233761B2

(12) United States Patent
Snider et al.

(10) Patent No.: US 10,233,761 B2
(45) Date of Patent: Mar. 19, 2019

(54) TURBINE AIRFOIL TRAILING EDGE COOLANT PASSAGE CREATED BY COVER

(71) Applicant: General Electric Company, Schenectady, NY (US)

(72) Inventors: Zachary John Snider, Simpsonville, SC (US); Gregory Thomas Foster, Greer, SC (US); Joseph Anthony Weber, Simpsonville, SC (US); James Fredric Wiedenhoefer, Clifton Park, NY (US)

(73) Assignee: General Electric Company, Schenectady, NY (US)

( * ) Notice: Subject to any disclaimer, the term of this patent is extended or adjusted under 35 U.S.C. 154(b) by 198 days.

(21) Appl. No.: 15/334,450

(22) Filed: Oct. 26, 2016

(65) Prior Publication Data

US 2018/0112547 A1 Apr. 26, 2018

(51) Int. Cl.
*F01D 9/06* (2006.01)
*F01D 5/18* (2006.01)
(Continued)

(52) U.S. Cl.
CPC ..... *F01D 9/065* (2013.01); *F01D 5/147* (2013.01); *F01D 5/186* (2013.01); *F01D 5/187* (2013.01);
(Continued)

(58) Field of Classification Search
CPC ..... F01D 9/065; F01D 5/147; F01D 5/186; F01D 5/187; F01D 9/041; F01D 9/06; F01D 25/08; F01D 5/18; F05D 2260/202
(Continued)

(56) References Cited

U.S. PATENT DOCUMENTS 2,744,723 A 5/1956 Roush
3,220,697 A 11/1965 Smuland et al.
(Continued)

FOREIGN PATENT DOCUMENTS

GB 2 260 166 A 4/1993
WO 2012/092279 A1 7/2012

OTHER PUBLICATIONS

Extended European Search Report and Opinion issued in connection with corresponding EP Application No. 17196197.2 dated Mar. 7, 2018.

(Continued)

*Primary Examiner* — Nathaniel E Wiehe
*Assistant Examiner* — Emily S Adelman
(74) *Attorney, Agent, or Firm* — Ernest G. Cusick; Hoffman Warnick LLC

(57) ABSTRACT

A turbine airfoil for a rotating blade or stationary nozzle vane includes an airfoil body including a leading edge and a trailing edge. A coolant supply passage extends within the airfoil body, and a coolant return passage extends within the airfoil body. A first trench is in an external surface of the airfoil body, the first trench extending to the trailing edge and being in fluid communication with the coolant supply passage. A second trench is in the external surface of the airfoil body, the second trench extending to the trailing edge and being in fluid communication with the coolant return passage and the first trench. A cover seats in the airfoil body and encloses the trenches to form coolant passages with the airfoil body. In embodiments, two coolant passages to and back from the trailing edge may be used to allow for a recycling flow.

20 Claims, 8 Drawing Sheets

(51) Int. Cl.
*F01D 25/08* (2006.01)
*F01D 5/14* (2006.01)
*F01D 9/04* (2006.01)

(52) U.S. Cl.
CPC ..... *F01D 9/041* (2013.01); *F01D 9/06* (2013.01); *F01D 25/08* (2013.01); *F05D 2220/32* (2013.01); *F05D 2240/122* (2013.01); *F05D 2240/123* (2013.01); *F05D 2240/124* (2013.01); *F05D 2240/305* (2013.01); *F05D 2240/306* (2013.01); *F05D 2260/202* (2013.01); *F05D 2260/204* (2013.01)

(58) Field of Classification Search
USPC ..... 415/115, 116; 416/95; 60/805
See application file for complete search history.

(56) References Cited

U.S. PATENT DOCUMENTS 3,844,679 A * 10/1974 Grondahl ..... F01D 5/185 416/95
3,849,025 A 11/1974 Grondahl
4,021,139 A 5/1977 Franklin
4,302,153 A 11/1981 Tubbs
4,684,322 A 8/1987 Clifford et al.
4,761,116 A 8/1988 Braddy et al.
4,940,388 A 7/1990 Lilleker et al.
5,100,293 A 3/1992 Anzai et al.
5,464,322 A 11/1995 Cunha et al.
5,536,143 A 7/1996 Jacala et al.
5,915,923 A 6/1999 Tomita et al.
5,967,752 A 10/1999 Lee et al.
5,997,251 A 12/1999 Lee
6,099,252 A 8/2000 Manning et al.
6,227,804 B1 5/2001 Koga et al.
6,247,896 B1 6/2001 Auxier et al.
6,499,949 B2 12/2002 Schafrik et al.
7,435,053 B2 10/2008 Liang
7,530,789 B1 5/2009 Liang
7,670,113 B1 3/2010 Liang
7,717,675 B1 5/2010 Liang
7,785,070 B2 8/2010 Liang
7,845,906 B2 12/2010 Spangler et al.
7,985,049 B1 7/2011 Liang
8,047,788 B1 11/2011 Liang
8,317,472 B1 11/2012 Liang
8,322,988 B1 12/2012 Downs et al.
8,398,370 B1 3/2013 Liang
8,562,295 B1 10/2013 Liang
8,608,430 B1 12/2013 Liang
8,628,298 B1 1/2014 Liang
8,790,083 B1 7/2014 Liang
8,864,469 B1 10/2014 Liang
9,447,692 B1 9/2016 Liang
9,970,302 B2 5/2018 Lacy et al.
2005/0058534 A1 3/2005 Lee et al.
2009/0193657 A1* 8/2009 Wilson, Jr. ..... F01D 5/147 29/889.721
2010/0303625 A1* 12/2010 Kuhne ..... F01D 5/20 416/91
2013/0108471 A1 5/2013 Fujimoto
2013/0272850 A1* 10/2013 Bunker ..... F01D 5/147 415/116
2014/0093379 A1 4/2014 Tibbott et al.
2014/0127013 A1 5/2014 Spangler et al.
2015/0041590 A1* 2/2015 Kirtley ..... F01D 5/187 244/123.1
2015/0044059 A1 2/2015 Wassynger et al.
2015/0059357 A1 3/2015 Morgan et al.
2015/0096305 A1 4/2015 Morgan et al.
2015/0147164 A1 5/2015 Cui et al.
2015/0252728 A1 9/2015 Veiga
2015/0345303 A1 12/2015 Dong et al.
2016/0169003 A1 6/2016 Wong et al.
2016/0177741 A1 6/2016 Kirollos et al.
2017/0350259 A1 12/2017 Dutta et al.
2018/0112533 A1 4/2018 Wayne et al.
2018/0112534 A1 4/2018 Snider et al.
2018/0112535 A1 4/2018 Weber et al.
2018/0112536 A1 4/2018 Weber et al.
2018/0112537 A1 4/2018 Weber et al.
2018/0112538 A1 4/2018 Weber et al.
2018/0112539 A1 4/2018 Weber et al.
2018/0112540 A1 4/2018 Hoskin et al.
2018/0112541 A1 4/2018 Weber et al.
2018/0230815 A1 8/2018 Jones

OTHER PUBLICATIONS

U.S. Appl. No. 15/334,483, Office Action dated Jun. 28, 2018, 13 pages.
U.S. Appl. No. 15/334,585, Office Action dated Jul. 31, 2018, 22 pages.
U.S. Appl. No. 15/334,517, Office Action dated Aug. 6, 2018, 24 pages.
U.S. Appl. No. 15/334,501, Office Action dated Aug. 10, 2018, 17 pages.
U.S. Appl. No. 15/334,563, Office Action dated Dec. 12, 2018, 18 pages.
U.S. Appl. No. 15/334,474, Office Action dated Dec. 31, 2018, 13 pages.
U.S. Appl. No. 15/334,501, Notice of Allowance dated Jan. 17, 2019, 11 pages.

* cited by examiner

TURBINE AIRFOIL TRAILING EDGE COOLANT PASSAGE CREATED BY COVER

This application is related to co-pending U.S. application Ser. Nos. 15/334,474, 15/334,454, 15/334,563, 15/334,585, 15/334,448, 15/334,501, 15/334,517, 15/334,471, and 15/334,483, all filed on Oct. 26, 2016.

BACKGROUND OF THE INVENTION

The disclosure relates generally to turbomachines, and more particularly, to a turbine airfoil having a near wall, trailing edge cooling circuit formed by a cover and allowing coolant recycling.

Gas turbine systems are one example of turbomachines widely utilized in fields such as power generation. A conventional gas turbine system includes a compressor section, a combustor section, and a turbine section. During operation of a gas turbine system, various components in the system, such as turbine blades and nozzle/vane airfoils, are subjected to high temperature flows, which can cause the components to fail. Since higher temperature flows generally result in increased performance, efficiency, and power output of a gas turbine system, it is advantageous to cool the components that are subjected to high temperature flows to allow the gas turbine system to operate at increased temperatures.

A multi-wall rotating blade or stationary nozzle typically contains an intricate maze of internal cooling passages. Cooling air provided by, for example, a compressor of a gas turbine system, may be passed through and out of the cooling passages to cool various portions of the multi all blade. Cooling circuits formed by one or more cooling passages in a multi-wall blade/nozzle may include, for example, internal near wall cooling circuits, internal central cooling circuits, tip cooling circuits, and cooling circuits adjacent the leading and trailing edges of the multi wall blade. In order to cool a tip of a trailing edge of a turbine airfoil and because the trailing edge provides very little internal space for defining a cooling circuit, coolant for the trailing edge is typically delivered in one or both of the following ways. In one approach, the airfoils include a coolant passage(s) that delivers a coolant through and out of the trailing edge, and in another approach, coolant is delivered out a side of the airfoil and across an exterior surface immediately upstream of the tip of the leading edge. In either approach, the coolant is delivered only in a single, downstream direction out to the hot gas path of the turbine. Once the coolant leaves the airfoil it is lost and cannot be recycled for cooling other parts.

BRIEF DESCRIPTION OF THE INVENTION

A first aspect of the disclosure provides a turbine airfoil, comprising: an airfoil body including a leading edge and a trailing edge; a coolant supply passage extending within the airfoil body; a coolant return passage extending within the airfoil body; a first trench in an external surface of the airfoil body, the first trench extending to the trailing edge and being in fluid communication with the coolant supply passage; a second trench in the external surface of the airfoil body, the second trench extending to the trailing edge and being in fluid communication with the coolant return passage and the first trench; and a seat in an exterior surface of the airfoil body for receiving a cover configured to enclose the first and second trenches and form coolant passages with the airfoil body.

A second aspect of the disclosure provides a turbine blade or nozzle, comprising: an airfoil body including a leading edge and a trailing edge; a coolant supply passage extending within the airfoil body; a coolant return passage extending within the airfoil body; a first trench in an external surface of the airfoil body, the first trench extending to the trailing edge and being in fluid communication with the coolant supply passage; a second trench in the external surface of the airfoil body, the second trench extending to the trailing edge and being in fluid communication with the coolant return passage and the first trench; a cover seat in an exterior surface of the airfoil body; and a cover positioned in the cover seat and enclosing the first and second trenches to form coolant passages with the airfoil body.

A third aspect of the disclosure provides a turbine blade or nozzle, comprising: an airfoil body including a leading edge and a trailing edge; a coolant supply passage extending within the airfoil body; a coolant return passage extending within the airfoil body; a first trench in an external surface of the airfoil body, the first trench extending to the trailing edge and being in fluid communication with the coolant supply passage; a second trench in the external surface of the airfoil body, the second trench extending to the trailing edge and being in fluid communication with the coolant return passage and the first trench; and a cover seat in an exterior surface of the airfoil body; and a cover positioned in the cover seat and enclosing the first and second trenches to form coolant passages with the airfoil body, wherein each trench has a first radial extent and a second radial extent, the first radial extent at a location upstream of a second radial extent and the second radial extent being larger than the first radial extent, and wherein the trailing edge is devoid of any coolant passage exiting through the trailing edge.

The illustrative aspects of the present disclosure are designed to solve the problems herein described and/or other problems not discussed.

BRIEF DESCRIPTION OF THE DRAWINGS

These and other features of this disclosure will be more readily understood from the following detailed description of the various aspects of the disclosure taken in conjunction with the accompanying drawings that depict various embodiments of the disclosure, in which.

It is noted that the drawings of the disclosure are not to scale. The drawings are intended to depict only typical aspects of the disclosure, and therefore should not be considered as limiting the scope of the disclosure. In the drawings, like numbering represents like elements between the drawings.

DETAILED DESCRIPTION OF THE INVENTION

Figure 1:
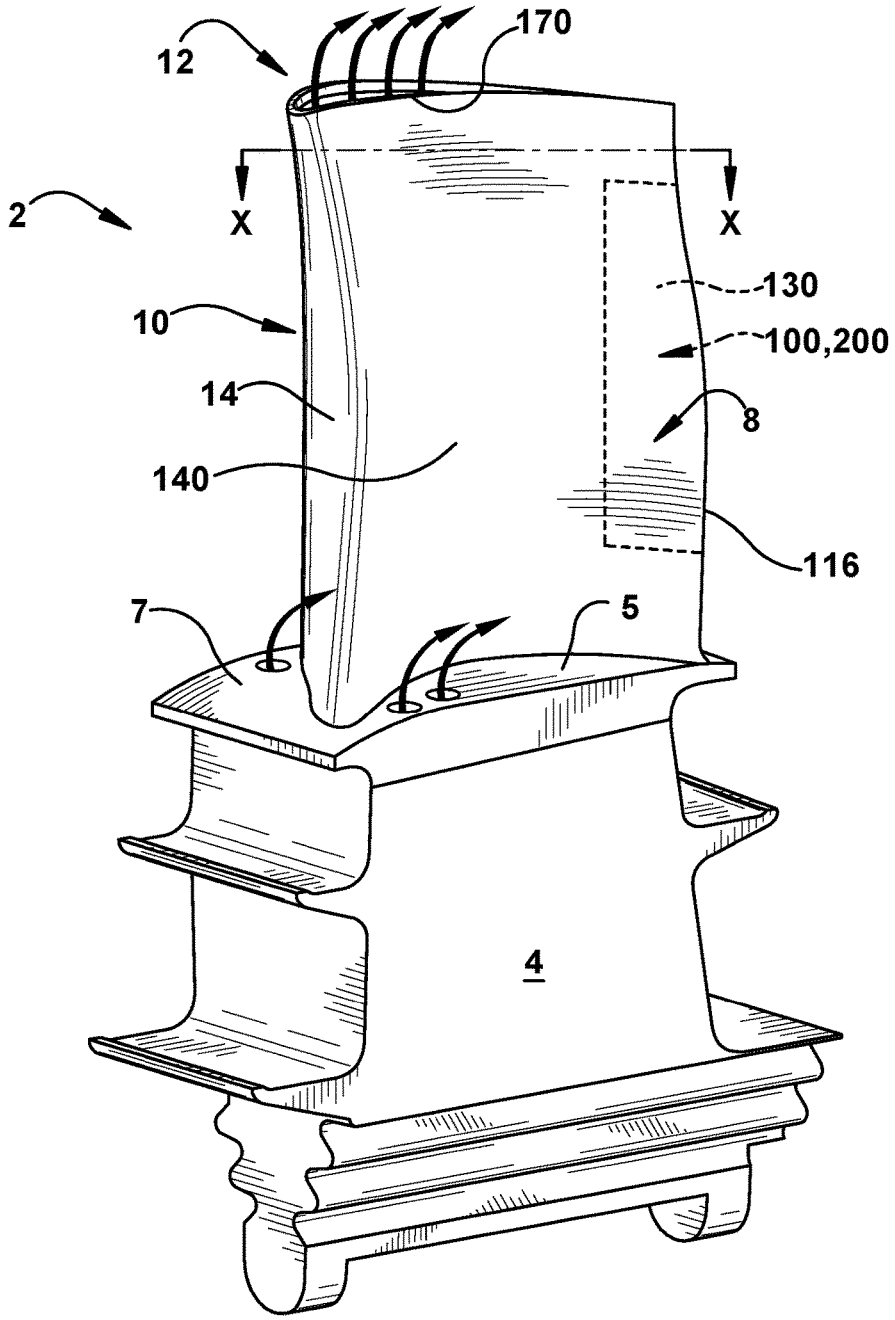
FIG. 1 shows a perspective view of a multi-wall blade/nozzle according to various embodiments.

As an initial matter, in order to clearly describe the current disclosure it will become necessary to select certain terminology when referring to and describing relevant machine components within a gas turbine. When doing this, if possible, common industry terminology will be used and employed in a manner consistent with its accepted meaning. Unless otherwise stated, such terminology should be given a broad interpretation consistent with the context of the present application and the scope of the appended claims. Those of ordinary skill in the art will appreciate that often a particular component may be referred to using several different or overlapping terms. What may be described herein as being a single part may include and be referenced in another context as consisting of multiple components. Alternatively, what may be described herein as including multiple components may be referred to elsewhere as a single part.

In addition, several descriptive terms may be used regularly herein, and it should prove helpful to define these terms at the onset of this section. These terms and their definitions, unless stated otherwise, are as follows. As used herein, "downstream" and "upstream" are terms that indicate a direction relative to the flow of a fluid, such as the working fluid through the turbine engine or, for example, the flow of air through the combustor or coolant through one of the turbine's component systems. The term "downstream" corresponds to the direction of flow of the fluid, and the term "upstream" refers to the direction opposite to the flow. The terms "forward" and "aft," without any further specificity, refer to directions, with "forward" referring to the front or compressor end of the engine, and "aft" referring to the rearward or turbine end of the engine. It is often required to describe parts that are at differing radial positions with regard to a center axis. The term "radial" refers to movement or position perpendicular to an axis. In cases such as this, if a first component resides closer to the axis than a second component, it will be stated herein that the first component is "radially inward" or "inboard" of the second component. If, on the other hand, the first component resides further from the axis than the second component, it may be stated herein that the first component is "radially outward" or "outboard" of the second component. The term "axial" refers to movement or position parallel to an axis ("A") (see, FIG. 8). Finally, the term "circumferential" refers to movement or position around an axis. It will be appreciated that such terms may be applied in relation to the center axis of the turbine.

According to embodiments, a trailing edge cooling circuit with flow reuse is provided for cooling a turbine airfoil of a multi-wall blade/nozzle of a turbine system (e.g., a gas turbine system). A flow of cooling air is reused after flowing through the trailing edge cooling circuit. After passing through the trailing edge cooling circuit, the flow of cooling air may be collected and used to cool other sections of the turbine airfoil, other parts of the blade/nozzle, or other downstream components. For example, the flow of cooling air may be directed to at least one of the pressure or suction sides of the multi-wall blade/nozzle for convection and/or film cooling. Further, the flow of cooling air may be provided to other cooling circuits within the multi-wall blade/nozzle, including tip, and platform cooling circuits.

Traditional trailing edge cooling circuits typically eject the flow of cooling air out through a trailing edge cooling circuit. This is not an efficient use of the cooling air, since the cooling air may not have been used to its maximum heat capacity before being exhausted from the turbine airfoil. Contrastingly, according to embodiments, a flow of coolant (e.g., air), after passing through a trailing edge cooling circuit, is used for further cooling of the multi-wall blade/nozzle in the form of additional convective cooling or film coverage.

Turning to FIG. 1, a perspective view of an illustrative multi-walled turbine blade/nozzle 2 is shown. While FIG. 1 shows blade/nozzle 2 as a turbine rotating blade, it is understood that the teachings of the disclosure are equally applicable to a turbine stationary nozzle vane having similar structure to blade/nozzle 2, but including an outer platform. Consequently, the description shall refer to the blade herein as a blade/nozzle 2. Turbine blade/nozzle 2 includes a shank 4 and a multi-wall turbine airfoil 106 coupled to and extending radially outward from shank 4. Multi-wall turbine airfoil 106 includes a pressure side 8, an opposed suction side 10, and a tip area 12. Multi-wall turbine airfoil 106 further includes a leading edge 14 between pressure side 8 and suction side 10, as well as a trailing edge 116 between pressure side 8 and suction side 10 on a side opposing leading edge 14. Trailing edge 116 includes a cooling circuit configured according to embodiments of the disclosure. Multi-wall turbine airfoil 106 extends radially away from a pressure side platform 5 and a suction side platform 7.

Shank 4 and multi-wall turbine airfoil 106 may each be formed of one or more metals (e.g., nickel, alloys of nickel, etc.) and may be formed (e.g., cast, forged, additively manufactured or otherwise machined) according to conventional approaches. Shank 4 and multi-wall turbine airfoil 106 may be integrally formed (e.g., cast, forged, three-dimensionally printed, etc.), or may be formed as separate components which are subsequently joined (e.g., via welding, brazing, bonding or other coupling mechanism). While the teachings of the disclosure will be described herein relative to blade/nozzle 2, it is emphasized that the teachings are equally applicable to any turbine airfoil, including those employed with stationary nozzles/vanes.

Figure 2:
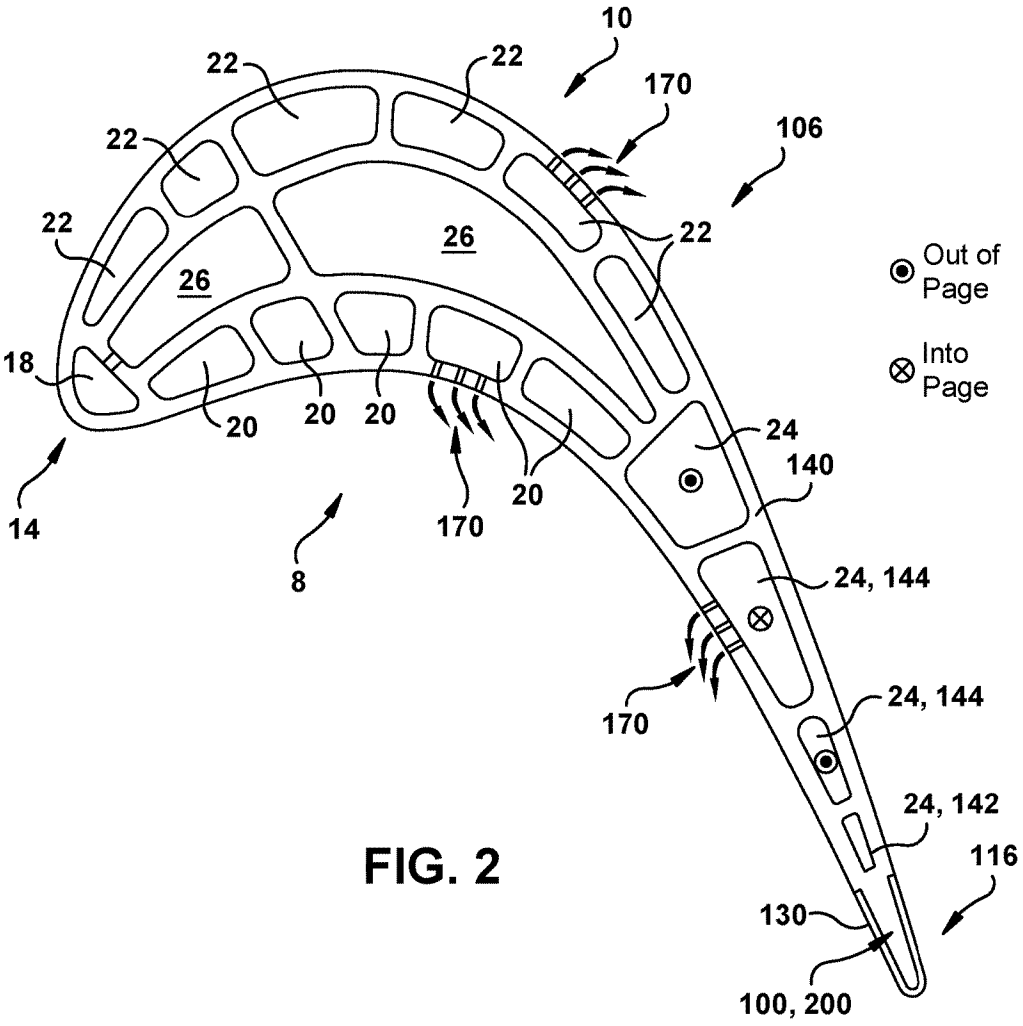
FIG. 2 shows a cross-sectional view of an illustrative multi-wall blade/nozzle according to various embodiments.

FIG. 2 depicts a cross-sectional view of multi-wall turbine airfoil 106 taken along line X-X of FIG. 1. As shown, multi-wall turbine airfoil 106 may include a plurality of internal passages. In embodiments, multi-wall turbine airfoil 106 includes at least one leading edge passage 18, at least one pressure side (near wall) passage 20, at least one suction side (near wall) passage 22, at least one trailing edge passage 24, and at least one central passage 26. The number of passages 18, 20, 22, 24, 26 within multi-wall turbine airfoil 106 may vary, of course, depending upon for example, the specific configuration, size, intended use, etc., of multi-wall turbine airfoil 106. To this extent, the number of passages 18, 20, 22, 24, 26 shown in the embodiments disclosed herein is not meant to be limiting. According to embodiments, various cooling circuits can be provided using different combinations of passages 18, 20, 22, 24, 26.

Figure 3:
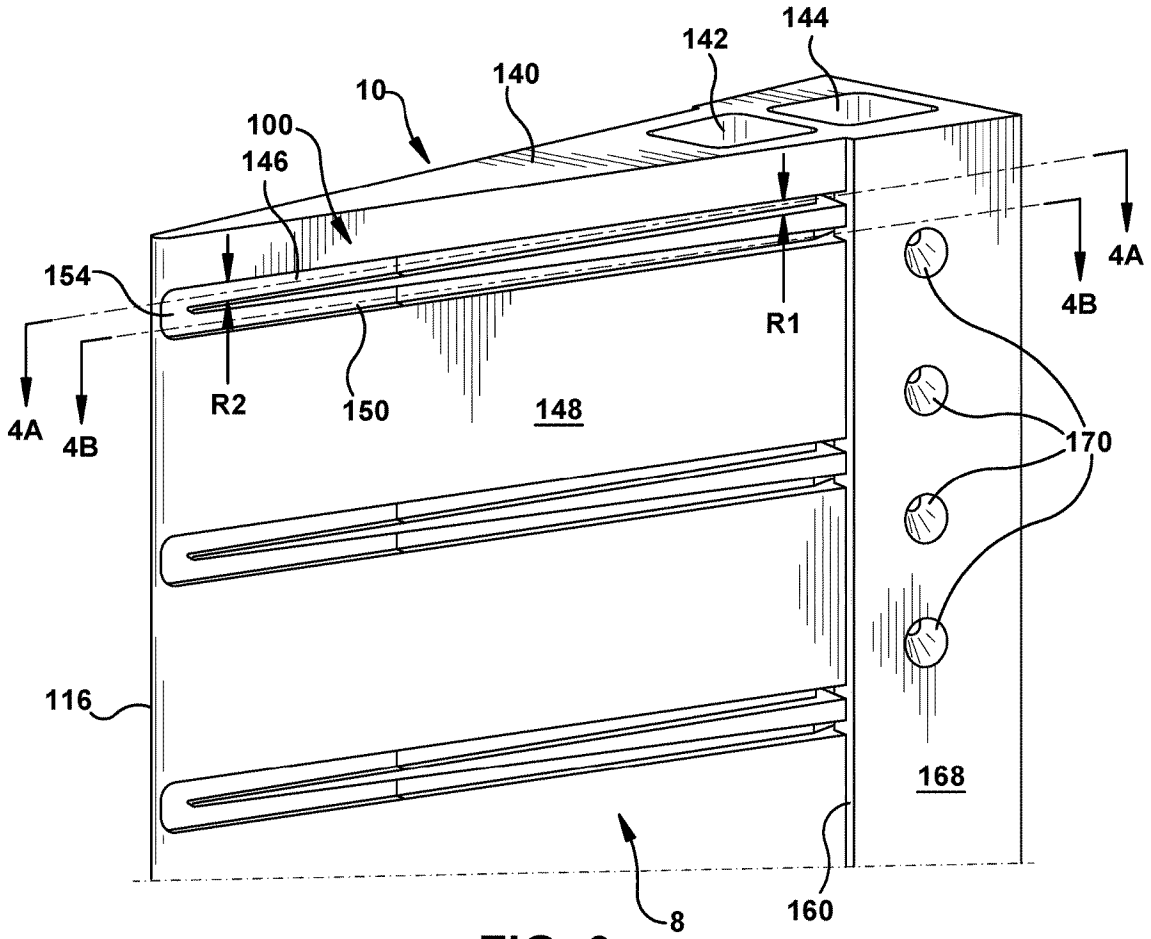
FIG. 3 shows a perspective view of a turbine airfoil body for the multi-wall blade/nozzle including a cooling circuit without a cover according to various embodiments.
Figure 4A:
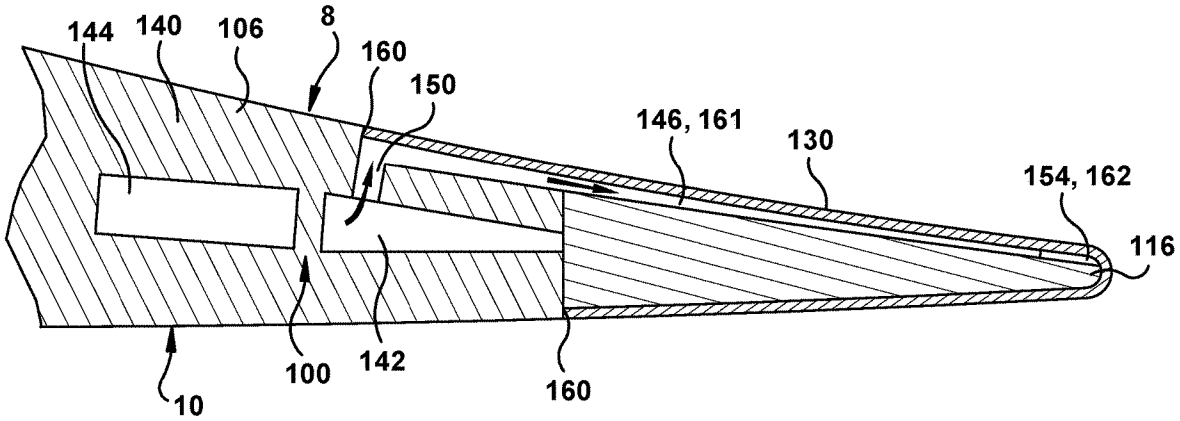
FIG. 4A shows a cross-sectional view of the turbine airfoil body of FIG. 3 along line 4A-4A.
Figure 4B:
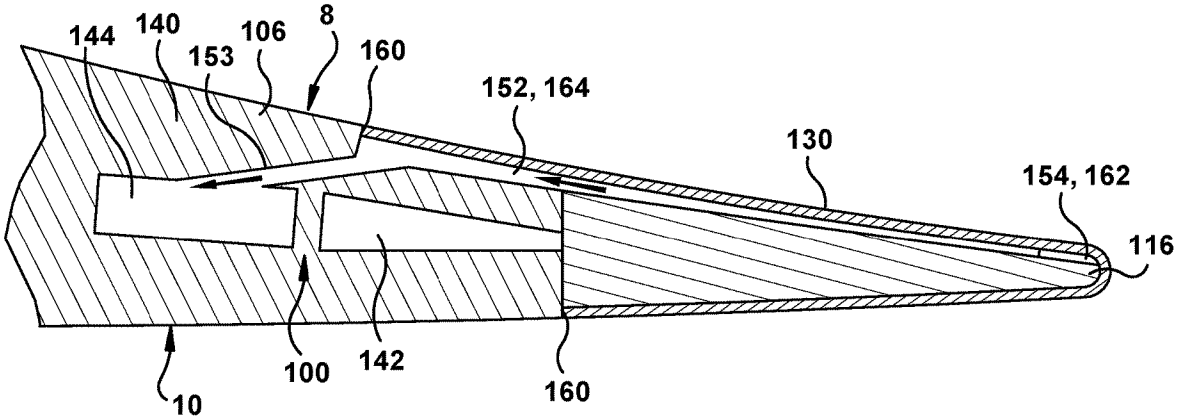
FIG. 4B shows a cross-sectional view of the turbine airfoil body of FIG. 3 along line 4B-4B, each with a cover according to various embodiments.

As shown generally in FIGS. 1-2, a trailing edge cooling circuit 100 in multi-walled turbine airfoil 106 may be formed using a cover 130 in conjunction with trenches (FIGS. 3-7) in an exterior surface of an airfoil body 140 according to embodiments of the disclosure. FIGS. 3-7 depict details of embodiments of trailing edge cooling circuit 100 according to various embodiments. FIG. 3 shows a perspective view of one embodiment of trailing edge 116 of turbine airfoil 106 without a cover 130, and FIGS. 4A-B show an enlarged cross-sectional view of trailing edge 116 along line 4A-4A and line 4B-4B in FIG. 3, respectively, with a cover 130 according to various embodiments. As the name indicates, trailing edge cooling circuit 100 is located adjacent and/or within trailing edge 116 of multi-wall turbine airfoil 106. As noted, turbine airfoil 106 may be employed with a turbine blade or nozzle, as understood in the art.

Turning to FIGS. 3-7, turbine airfoil 106 includes an airfoil body 140 including a leading edge (14 in FIG. 2) and a trailing edge 116. A coolant supply passage 142 may extend within airfoil body 140, and a coolant return passage 144 may extend within airfoil body 140. Coolant supply passage 140 may be coupled to any now known or later developed source of a coolant flow, e.g., a coolant flow generated for example by a compressor 204 (FIG. 8) of a gas turbine system 202 (FIG. 8), flows into trailing edge cooling circuit 100. As illustrate, coolant return passage 144 is immediately forward (upstream) of coolant supply passage 142 within airfoil body 140, but either passage 142, 144 may include any other coolant passage 18, 20, 22, 24 (FIG. 2) within airfoil body 140.

As shown in FIG. 3, turbine airfoil 106 also includes a first trench 146 positioned in an external surface 148 of airfoil body 140. As shown in FIG. 4A, first trench 146 extends to trailing edge 116 from, and is in fluid communication, with coolant supply passage 142. First trench 146 may fluidly communicate with coolant supply passage 142 via a connector passage 150, shown in FIG. 4A. As shown in FIGS. 3 and 4B, turbine airfoil 106 also includes a second trench 152 in external surface 148 of airfoil body 140. As shown in FIG. 4B, second trench 152 extends to trailing edge 116 from, and is in fluid communication with coolant return passage 144 and first trench 146. Second trench 152 may fluidly couple to coolant return passage 144 via a connector passage 153, shown in FIG. 4B. As shown best in FIG. 3, second trench 152 may fluidly communicate with first trench 146 via a bight trench 154, which extends radially in external surface 148 to fluidly couple the radially spaced trenches 146, 152. While first and second trenches 146, 152 are shown positioned in external surface 148 of pressure side 8 of turbine airfoil 106, they may alternatively be positioned in suction side 10 of airfoil body 140. Similarly, bight trench 154 may be positioned at trailing edge 116 and in external surface 148 of whichever side 8 or 10 of airfoil body 140 is selected. As shown in FIG. 3 for first trench 146 only (for clarity), each of first and second trench 146, 152 may have a first radial extent R1 at a location upstream of a second radial extent R2 arranged such that second radial extent R2 is larger than first radial extent R1. That is, trenches 146, 152 are radially larger (taller) closer to trailing edge 116 than they are upstream where they fluidly connect to supply and return passages 142, 144 which provides more cooling to trailing edge 116, as described herein. In other embodiments, changes in radial extents R1, R2 may be omitted.

Turbine airfoil 106 also includes a seat 160 in external surface 148 of airfoil body 140 for receiving cover 130 (FIGS. 4A-4B). Cover 130 is configured to enclose first and second trenches 146, 152 and form coolant passages with airfoil body 140. Seat 160 may include any necessary shaped edges to mate with and receive cover 130 such that the cover can be coupled to airfoil body 140, e.g., via brazing or welding, followed by any necessary finishing. Turbine airfoil 106 may also include cover 130 configured to mate with trailing edge 116 and external surface 148 (on both pressure side 8 and suction side 10) so as to form coolant passages with trenches 146, 152, 154. Cover 130 can be formed in sections, but in any event forms trailing edge 116 in such a way that it is devoid of any coolant passage exiting through the trailing edge. That is, it forms a solid trailing edge 116.

In operation, as shown in FIGS. 4A-4B, coolant is: directed through coolant supply passage 142 (into or out of page), through connector passage 150 to a first coolant passage 161 formed by first trench 146 and cover 130 to trailing edge 116, then through a bight coolant passage 162 formed by bight trench 154 with cover 130 located directly at trailing edge 116, and then returns to return coolant passage 144 by a second coolant passage 164 formed by second trench 152 and cover 130 from trailing edge 116 and connector passage 153. Once in return coolant passage 144, coolant can be reused in any number of ways. For example, in one optional embodiment shown in FIG. 3, a plurality of openings 170 from coolant return passage 144 may exit to a portion of exterior surface 168 of airfoil body 140 upstream from seat 160 so as to form a coolant film on pressure side 8 or suction side 10. As shown in FIGS. 1 and 2, openings 170 can be provided in a large number of alternative positions.

Trenches 146, 152, 154 and seat 160 may be formed external surface 148 of airfoil body 140 in any now known or later developed fashion, e.g., machining, casting, additive manufacturing, etc. Trenches 146, 152 may have a depth into external surface 148 in the range of, for example, but not limited to 0.1 millimeters (mm) to 5 mm, depending on the desired cooling and size of turbine airfoil 106. The radial extents R1 and R2 may also range from, but not be limited to 0.1 mm to 10 mm, depending on the structural limits of the cover. As shown in FIG. 3, trailing edge cooling circuit 100, including trenches 146, 152, 154, may repeat in a radially spaced manner along trailing edge 116. Any number of circuits 100 may be employed to provide any desired amount of cooling. Cover 130 may be made of the same material as airfoil body 140 or may be another material, e.g., a pre-sintered preform (PSP) material. As understood, pre-sintered preform is a structure formed of a metal alloy powder pressed into a desired shape. The metal alloy includes brazing alloys therein that assist in brazing connection with airfoil body 140. It is noted, however, that PSP material is just one way of making cover, as cover 130 could also be made by casting or additive manufacturing. In any event, cover 130 seals against external surface 148 to form passages 161, 162, and is fixed to airfoil body 140.

Figure 5B:
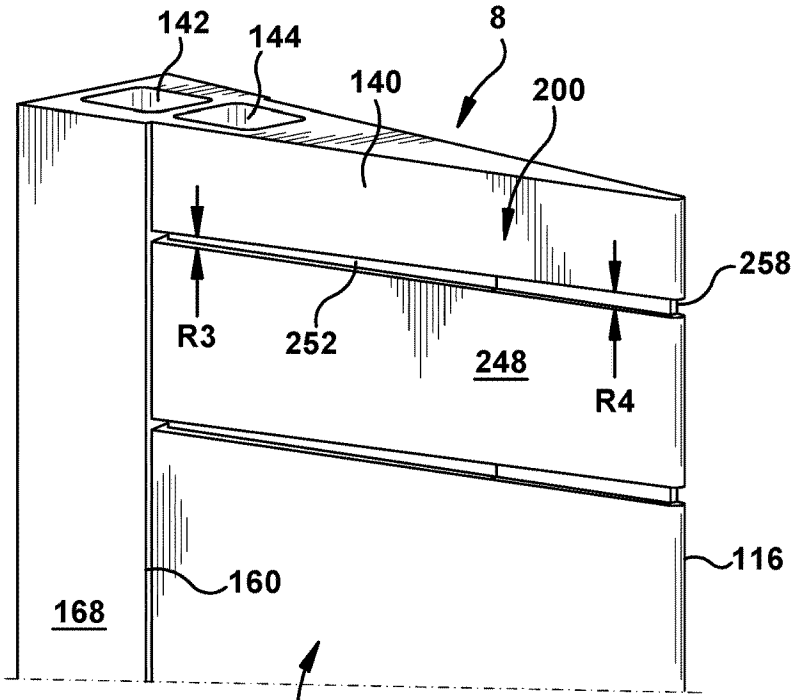
FIG. 5B shows a perspective view of a suction side of the turbine airfoil body of FIG. 5A, according to various embodiments.
Figure 5A:
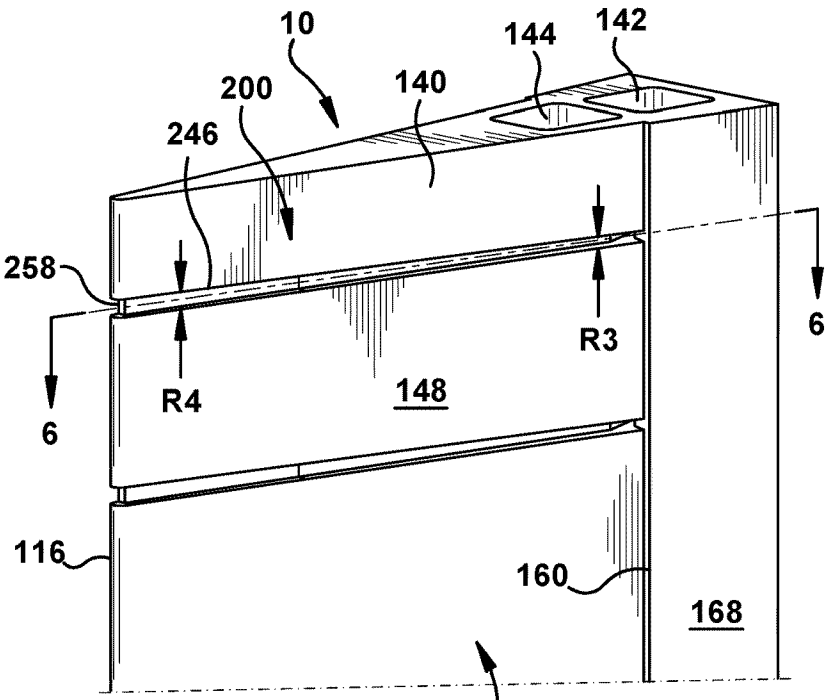
FIG. 5A shows a perspective view of a pressure side of a turbine airfoil body for a multi-wall blade/nozzle including a cooling circuit without a cover.
Figure 6:
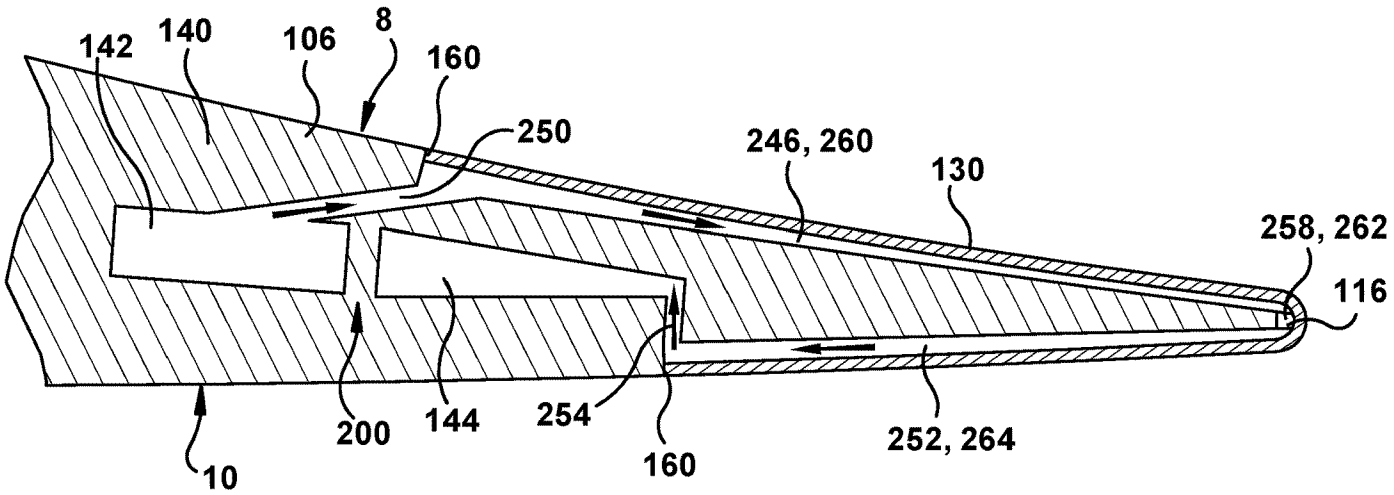
FIG. 6 shows a cross-sectional view of the turbine airfoil body of FIGS. 5A and 5B along line 6-6 with a cover according to various embodiments.

Turning to FIGS. 5A, 5B and 6, another embodiment of a trailing edge cooling circuit 200 is illustrated. FIG. 5A shows a perspective view of suction side 10 of airfoil body 140 for a multi-wall airfoil 106 (FIG. 1) including a cooling circuit 200, and FIG. 5B shows a perspective view of pressure side 8 of airfoil body 140. FIG. 6 shows a cross-sectional view of airfoil body 140 of FIGS. 5A and 5B along line 6-6. In FIGS. 5A, 5B and 6, in contrast to the FIGS. 3, 4A-B embodiment, coolant return passage 144 is downstream of coolant supply passage 142. In this embodiment, a first trench 246 is positioned in external surface 148 of a selected one of pressure side 8 (as shown in FIG. 5A) and suction side 10 of airfoil body 140, and a second trench 252 is positioned in external surface 248 of the other of pressure side 8 and suction side 10 (as shown in FIG. 5B) of airfoil body 140. In contrast to FIGS. 3 and 4A-B, in this embodiment, first trench 246 is fluidly coupled to second trench 252 by a bight trench 258 spanning trailing edge 116 between external surfaces 148, 248 of pressure side 8 and suction side 10, respectively, of airfoil body 140. That is, trenches 246 and 252 can exchange coolant around trailing edge 116 via bight trench 258. As shown in FIG. 6, first trench 246 fluidly communicates with supply coolant passage 142 via a connector passage 250, and second trench 252 fluidly communicates with return coolant passage 144 via a connector passage 254.

As shown in FIGS. 5A and 5B, each of first and second trench 246, 252 may have a first radial extent R3 at a location upstream of a second radial extent R4 arranged such that second radial extent R4 is larger than first radial extent R3. That is, trenches 246, 252 are radially larger (taller) closer to trailing edge 116 than they are upstream where they fluidly connect to passages 142, 144, which provides more cooling to trailing edge 116, as described herein. In other embodiments, changes in radial extents R3, R4 may be omitted.

In this embodiment, turbine airfoil 106 may also include seat 160 in exterior surfaces 148, 248 of airfoil body 140 for receiving cover 130 (FIG. 6). As in the previous embodiment, cover 130 is configured to enclose first and second trenches 246, 252 and form coolant passages with airfoil body 140. Seat 160 may include any necessary shaped edges to mate with and receive cover 130 such that the cover can be coupled to airfoil body 140, e.g., via brazing or welding, followed by any necessary finishing. Turbine airfoil 106 may also include cover 130 configured to mate with trailing edge 116 and exterior surfaces 148, 248 (on both pressure side 8 and suction side 10) so as to form coolant passages with trenches 246, 252, 258. Cover 130 can be formed in sections, but in any event forms trailing edge 116 in such a way that it is devoid of any coolant passage exiting through the trailing edge. That is, it forms a solid trailing edge 116.

In operation, as shown in FIG. 6, coolant is: directed through coolant supply passage 142 (into or out of page), through connector passage 250 to a first coolant passage 260 formed by first trench 246 and cover 130 to trailing edge 116, then through a bight coolant passage 262 formed by bight trench 258 with cover 130 located directly at trailing edge 116, and then returns to return coolant return passage 144 by a second coolant passage 264 formed by second trench 252 and cover 130 from trailing edge 116 and connector passage 254. Once in return coolant passage 144, coolant can be reused in any number of ways. For example, as a coolant film on pressure side 8 or suction side 10, as in the FIG. 3 embodiment.

Trenches 246, 252, 258 and seat 160 may be formed in exterior surfaces 148, 248 of airfoil body 140 in any now known or later developed fashion, e.g., machining, casting, additive manufacturing, etc. Trenches 246, 252, 258 may have a depth into exterior surfaces 148, 248 in the range of, for example, but not limited to, 0.1 millimeters (mm) to 3 mm, depending on the desired cooling and size of turbine airfoil 106. The radial extents R1 and R2 may also range from, but not be limited to, 0.1 mm to 10 mm depending on the structural capabilities of the cover. As shown in FIG. 6, trailing edge cooling circuit 200, including trenches 246, 252, 258, may repeat in a radially spaced manner along trailing edge 116. Any number of circuits 200 may be employed to provide any desired amount of cooling. Cover 130 here may be made of any of the materials described previously herein. In any event, cover 130 seals against exterior surfaces 148, 248 to form passages 260, 262, 264, and is fixed to airfoil body 140.

Figure 7:
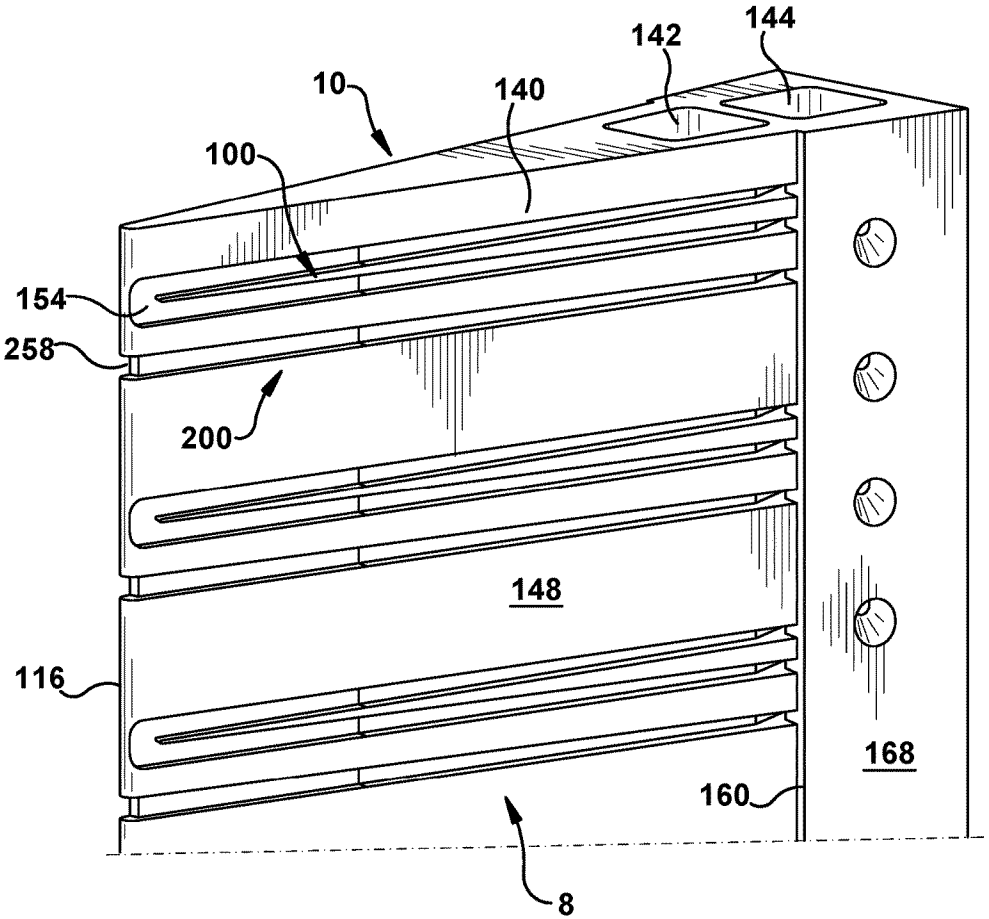
FIG. 7 shows a perspective view of a turbine airfoil body for the multi-wall blade/nozzle including two different cooling circuits according to various embodiments.

Turning to FIG. 7, which shows a perspective view of an airfoil body 140 without cover 130, in another embodiment trailing edge cooling circuits 100, 200 as described herein, may be employed together. They may be arranged in any pattern, e.g., an alternating pattern.

Figure 8:
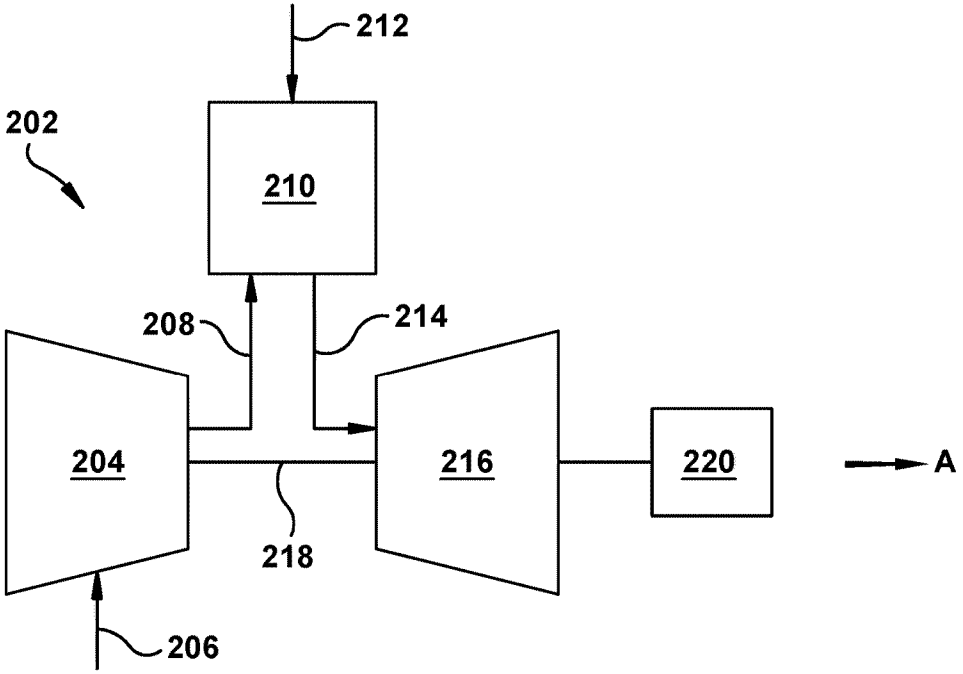
FIG. 8 shows a schematic view of an illustrative turbomachine system employing a turbine blade and/or nozzle including a turbine airfoil according to various embodiments.

FIG. 8 shows a schematic view of gas turbomachine 202 as may be used herein. Gas turbomachine 202 may include a compressor 204. Compressor 204 compresses an incoming flow of air 206, and delivers a flow of compressed air 208 to a combustor 210. Combustor 210 mixes the flow of compressed air 208 with a pressurized flow of fuel 212 and ignites the mixture to create a flow of combustion gases 214. Although only a single combustor 210 is shown, gas turbine system 202 may include any number of combustors 210. The flow of combustion gases 214 is in turn delivered to a turbine 216, which typically includes a plurality of the turbine blades and/or vanes employing a turbine airfoil 106, as described herein. The flow of combustion gases 214 drives turbine 216 to produce mechanical work. The mechanical work produced in turbine 216 drives compressor 204 via a shaft 218, and may be used to drive an external load 220, such as an electrical generator and/or the like.

Trailing edge cooling circuits 100, 200 as described herein enables turbine airfoil trailing edges that can be cooled to the tip without having to dump coolant through and out the trailing edge. Circuits 100, 200 thus allow for cooling a turbine component efficiently (high heat transfer, low pressure drop) while also reclaiming/recycling the coolant after it has been used for the trailing edge, so it can be diverted elsewhere in the system. It is understood, however, that to provide additional cooling of the trailing edge of multi-wall airfoil/blade and/or to provide cooling film directly to the trailing edge, exhaust passages (not shown) may pass from any part of any of the cooling circuit(s) or cover described herein through the trailing edge and out of the trailing edge and/or out of a side of the airfoil/blade adjacent to the trailing edge. Each exhaust passage(s) may be sized and/or positioned within the trailing edge to receive only a portion (e.g., less than half) of the coolant flowing in particular cooling circuit(s). Even with the inclusion of the exhaust passages(s), the majority (e.g., more than half) of the coolant may still flow through the cooling circuit(s), and specifically the return leg thereof, to subsequently be provided to distinct portions of multi-wall airfoil/blade for other purposes as described herein, e.g., film and/or impingement cooling.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof "Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about," "approximately" and "substantially," are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise. "Approximately" as applied to a particular value of a range applies to both values, and unless otherwise dependent on the precision of the instrument measuring the value, may indicate +/−10% of the stated value(s).

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. The embodiment was chosen and described in order to best explain the principles of the disclosure and the practical application, and to enable others of ordinary skill in the art to understand the disclosure for various embodiments with various modifications as are suited to the particular use contemplated.

What is claimed is:

1. A turbine airfoil, comprising:

an airfoil body including a leading edge and a trailing edge;

a coolant supply passage extending radially within the airfoil body;

a coolant return passage extending radially within the airfoil body, the coolant return passage positioned between the coolant supply passage and the leading edge;

a first trench in an external surface of the airfoil body, the first trench extending to the trailing edge and in fluid communication with the coolant supply passage to receive a cooling fluid from the coolant supply passage and provide the cooling fluid to the trailing edge;

a second trench in the external surface of the airfoil body, the second trench extending to the trailing edge and in fluid communication with the coolant return passage to provide the cooling fluid from the trailing edge to the coolant return passage;

a first bight trench formed adjacent the trailing edge, the first bight trench fluidly coupling the first trench to the second trench; and a seat in an exterior surface of the airfoil body for receiving a cover configured to enclose the first and second trenches and form coolant passages with the airfoil body.

2. The turbine airfoil of claim 1, wherein the first trench is positioned in the external surface of a selected one of a pressure side and a suction side of the airfoil body, and the second trench is also positioned in the external surface of the selected one of the pressure side and the suction side of the airfoil body radially spaced from the first trench, and wherein the first bight trench is formed in the external surface of the selected one of the pressure side and the suction side of the airfoil body.

3. The turbine airfoil of claim 2, further comprising a third trench radially spaced from the first and second trenches in the external surface of the selected one of the pressure side and the suction side of the airfoil body, and a fourth trench positioned in the external surface of the other of the pressure side and the suction side of the airfoil body, and wherein the third trench is fluidly coupled to the fourth trench by a second bight trench spanning the trailing edge between the external surfaces of the pressure side and the suction side of the airfoil body.

4. The turbine airfoil of claim 1, wherein the first trench is positioned in the external surface of a selected one of a pressure side and a suction side of the airfoil body, and the second trench is positioned in the external surface of the other of the pressure side and the suction side of the airfoil body, and wherein the first bight trench spans the trailing edge between the external surfaces of the pressure side and the suction side of the airfoil body.

5. The turbine airfoil of claim 1, further comprising a plurality of openings from the coolant return passage to a portion of the exterior surface of the airfoil body upstream from the seat.

6. The turbine airfoil of claim 1, further comprising the cover.

7. The turbine airfoil of claim 1, wherein each trench has a first radial extent and a second radial extent, the first radial extent at a location upstream of the second radial extent and the second radial extent being larger than the first radial extent.

8. The turbine airfoil of claim 1, wherein the trailing edge is devoid of any coolant passage exiting through the trailing edge.

9. A turbine airfoil, comprising:

an airfoil body including a leading edge and a trailing edge;

a coolant supply passage extending radially within the airfoil body;

a coolant return passage extending radially within the airfoil body, the coolant return passage positioned between the coolant supply passage and the leading edge;

a first trench in an external surface of the airfoil body, the first trench extending to the trailing edge and in fluid communication with the coolant supply passage to receive a cooling fluid from the coolant supply passage and provide the cooling fluid to the trailing edge;

a second trench in the external surface of the airfoil body, the second trench extending to the trailing edge and in fluid communication with the coolant return passage to provide the cooling fluid from the trailing edge to the coolant return passage;

a first bight trench formed adjacent the trailing edge, the first bight trench fluidly coupling the first trench to the second trench;

a cover seat in an exterior surface of the airfoil body; and a cover positioned in the cover seat and enclosing the first and second trenches to form coolant passages with the airfoil body.

10. The turbine airfoil of claim 9, wherein the first trench is positioned in the external surface of a selected one of a pressure side and a suction side of the airfoil body, and the second trench is also positioned in the external surface of the selected one of the pressure side and the suction side of the airfoil body radially spaced from the first trench, and wherein the first bight trench is formed in the external surface of the selected one of the pressure side and the suction side of the airfoil body.

11. The turbine airfoil of claim 10, further comprising a third trench radially spaced from the first and second trenches in the external surface of the selected one of the pressure side and the suction side of the airfoil body, and a fourth trench positioned in the external surface of the other of the pressure side and the suction side of the airfoil body, and wherein the third trench is fluidly coupled to the fourth trench by a second bight trench spanning the trailing edge between the external surfaces of the pressure side and the suction side of the airfoil body.

12. The turbine airfoil of claim 9, wherein the first trench is positioned in the external surface of a selected one of a pressure side and a suction side of the airfoil body, and the second trench is positioned in the external surface of the other of the pressure side and the suction side of the airfoil body, and wherein the first bight trench spans the trailing edge between the external surfaces of the pressure side and the suction side of the airfoil body.

13. The turbine airfoil of claim 9, further comprising a plurality of openings from the coolant return passage to a portion of the exterior surface of the airfoil body upstream from the seat.

14. The turbine airfoil of claim 9, wherein each trench has a first radial extent and a second radial extent, the first radial extent at a location upstream of the second radial extent and the second radial extent being larger than the first radial extent.

15. The turbine airfoil of claim 9, wherein the trailing edge is devoid of any coolant passage exiting through the trailing edge.

16. A turbine airfoil, comprising:

an airfoil body including a leading edge and a trailing edge;

a coolant supply passage extending within the airfoil body;

a coolant return passage extending within the airfoil body;

a first trench in an external surface of the airfoil body, the first trench extending to the trailing edge and being in fluid communication with the coolant supply passage;

a second trench in the external surface of the airfoil body, the second trench extending to the trailing edge and being in fluid communication with the coolant return passage and the first trench; and a cover seat in an exterior surface of the airfoil body; and a cover positioned in the cover seat and enclosing the first and second trenches to form coolant passages with the airfoil body, wherein each trench has a first radial extent and a second radial extent, the first radial extent at a location upstream of a second radial extent and the second radial extent being larger than the first radial extent, and wherein the trailing edge is devoid of any coolant passage exiting through the trailing edge.

17. The turbine airfoil of claim 16, wherein the first trench is positioned in the external surface of a selected one of a pressure side and a suction side of the airfoil body, and the second trench is also positioned in the external surface of the selected one of the pressure side and the suction side of the airfoil body radially spaced from the first trench, and wherein the first bight trench is formed in the external surface of the selected one of the pressure side and the suction side of the airfoil body.

18. The turbine airfoil of claim 17, further comprising a third trench radially spaced from the first and second trenches in the external surface of the selected one of the pressure side and the suction side of the airfoil body, and a fourth trench positioned in the external surface of the other of the pressure side and the suction side of the airfoil body, and wherein the third trench is fluidly coupled to the fourth trench by a second bight trench spanning the trailing edge between the external surfaces of the pressure side and the suction side of the airfoil body.

19. The turbine airfoil of claim 16, wherein the first trench is positioned in the external surface of a selected one of a pressure side and a suction side of the airfoil body, and the second trench is positioned in the external surface of the other of the pressure side and the suction side of the airfoil body, and wherein the first bight trench spans the trailing edge between the external surfaces of the pressure side and the suction side of the airfoil body.

20. The turbine airfoil of claim 16, further comprising a plurality of openings from the coolant return passage to a portion of the exterior surface of the airfoil body upstream from the seat.

* * * * *